US010071548B2

(12) United States Patent
Jauk et al.

(10) Patent No.: US 10,071,548 B2
(45) Date of Patent: Sep. 11, 2018

(54) PRINTING MODULE HAVING A PRINTING HEAD THAT CAN BE EXCHANGED ON THE FRONT SIDE

(71) Applicant: Durst Phototechnik AG, Brixen (IT)

(72) Inventors: Benjamin Christoph Jauk, Berwang (DE); Georg Grossrubatscher, Ehrenburg/Kiens (IT)

(73) Assignee: Durst Phototechnik AG, Brixen (IT)

( * ) Notice: Subject to any disclaimer, the term of this patent is extended or adjusted under 35 U.S.C. 154(b) by 0 days.

(21) Appl. No.: 15/502,529

(22) PCT Filed: Jul. 29, 2015

(86) PCT No.: PCT/EP2015/001557

§ 371 (c)(1),
(2) Date: Feb. 8, 2017

(87) PCT Pub. No.: WO2016/023620

PCT Pub. Date: Feb. 18, 2016

(65) Prior Publication Data

US 2017/0232769 A1 Aug. 17, 2017

(30) Foreign Application Priority Data

Aug. 13, 2014 (DE) ..... 10 2014 011 882
Sep. 16, 2014 (IT) ..... BZ2014A0035

(51) Int. Cl.
*B41J 3/54* (2006.01)
*B41J 2/01* (2006.01)
(Continued)

(52) U.S. Cl.
CPC ..... *B41J 2/01* (2013.01); *B41J 3/543* (2013.01); *B41J 25/34* (2013.01); *B41J 2/14* (2013.01);
(Continued)

(58) Field of Classification Search
CPC ..... B41J 2/01; B41J 3/543; B41J 25/34; B41J 2202/20; B41J 2/14024; B41J 2/14
See application file for complete search history.

(56) References Cited

U.S. PATENT DOCUMENTS 6,471,335 B1 * 10/2002 Gelbart ..... B41J 2/155 347/13
2002/0196318 A1 * 12/2002 Shimizu ..... B41J 2/175 347/85
(Continued)

FOREIGN PATENT DOCUMENTS

EP 0 506 107 B1 9/1992
JP 2005-169956 A 6/2005
(Continued)

OTHER PUBLICATIONS

International Search Report for PCT/EP2015/001557 dated Oct. 2, 2015.

*Primary Examiner* — Yaovi M Ameh
(74) *Attorney, Agent, or Firm* — Brinks Gilson & Lione

(57) ABSTRACT

Printing module comprising an assembly arranged on the front side for mounting a printing head in an inkjet printer, wherein the printing module is arranged at a distance in relation to a depositing device and the assembly has a carrier frame having an opening which extends through the carrier frame and is provided for receiving/releasing the printing head, wherein the assembly has means for mounting the printing head which make it possible to receive the same on the front side in a repair position of the printing module in relation to the depositing device.

12 Claims, 4 Drawing Sheets

Figure 1:
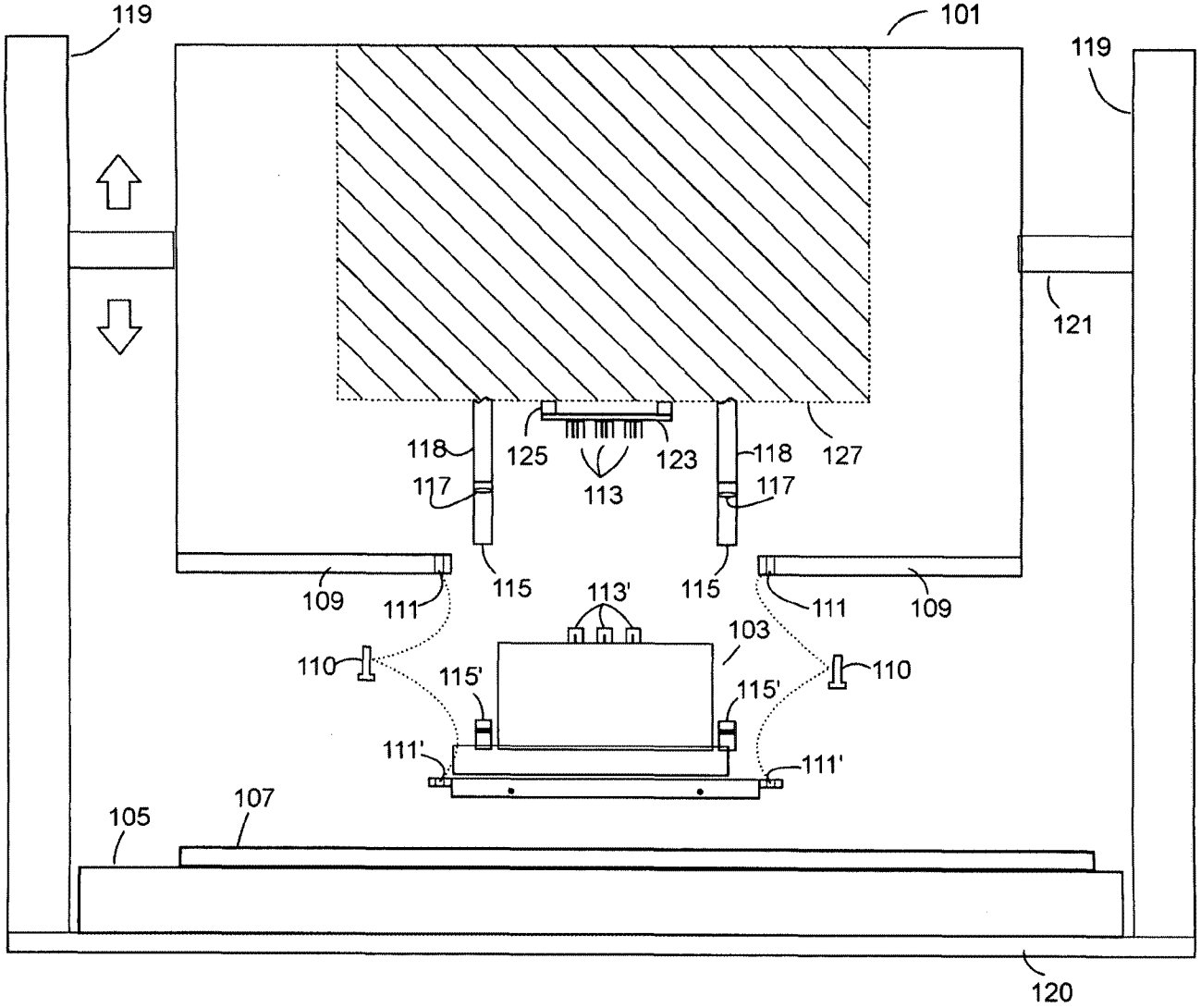

(51) Int. Cl.
*B41J 25/34* (2006.01)
*B41J 2/14* (2006.01)

(52) U.S. Cl.
CPC ..... *B41J 2/14024* (2013.01); *B41J 2202/20* (2013.01)

(56) References Cited

U.S. PATENT DOCUMENTS

| | | | | |
|---|---|---|---|---|
| 2003/0112315 | A1 | 6/2003 | Hetzer | |
| 2008/0145130 | A1* | 6/2008 | Marsden | B41J 2/145 400/692 |
| 2009/0051731 | A1* | 2/2009 | Miyazawa | B41J 2/16511 347/33 |
| 2012/0182349 | A1 | 7/2012 | Hagiwara | |

FOREIGN PATENT DOCUMENTS

| | | | |
|---|---|---|---|
| JP | 2012-111098 | A | 6/2012 |
| JP | 2013-248875 | A | 12/2013 |

* cited by examiner

PRINTING MODULE HAVING A PRINTING HEAD THAT CAN BE EXCHANGED ON THE FRONT SIDE

The present invention relates to a printing module having a printing head that can be replaced on the front side in an inkjet printer.

Inkjet printers usually comprise a printing module and a positioning device which is designed to be able to move the printing module and a medium with a surface to be printed in a predetermined manner at a constant distance of the printing module from the surface in two dimensions relative to one another. The printing module itself has at least one printing head with at least one row of nozzles which are arranged next to one another and by which the ink can be applied on the surface to be printed. In this respect the printing takes place by the ejection of ink drops according to a predetermined, if necessary variable, printing frequency and number of drops.

Scanning printers and single-pass printers are known in the prior art. In the case of a scanning printer a scanning printing module travels in one or several passes over a line of a medium to be printed, whilst this line is being printed. The corresponding process is called scanning process. If in a scanning process the printing of the line is completed, the medium to be printed is moved by one line vertically to the scanning direction carried out by the printing head into a feeding direction and the printing of the next line can begin.

A single-pass printer, however, is understood to mean a printer comprising a printing module which is positioned in a stationary manner over the medium to be printed and which has at least one printing head, wherein in the corresponding single-pass process the medium is continually moved in an operating mode and the at least one printing head sees the medium a single time, with the printing head itself being arranged at the printing module in a stationary manner.

As it is known, a printing module comprises on the front side a carrier which is designed as a frame having at least one opening which is provided for receiving a printing head and on which frame the mounting of the printing head is carried out, wherein in the case of known printing modules the frame can receive the printing head only from the top of the printing module, i.e. only on the rear side. The frame itself comprises adjusting devices for aligning the printing head. A plurality of electronic and mechanic components are provided on the frame and over the printing head for the regular operation of the printing head.

In order to meet the increasing requirements for saving space, the construction of printing modules has increasingly become more compact. An advantage resulting thereof is that, in addition to the saving in space, there is a saving in material costs. A consequence thereof, however, is that components have often to be installed one above another and particularly over the printing heads.

The more compact the construction of the printing module is, the more limited is the accessibility from its top and correspondingly the more difficult and time-consuming is the replacement of a printing head. In order to ensure the replacement of a printing head in case of repair, it is therefore necessary to disassemble at least a part of the components arranged in the printing module.

It is true that the compact construction of the printing modules has proven to be more space-saving and inter alia more resource-saving as regards its production, but it leads to insufficient efficiency in the maintenance, as it is more difficult to access them from their top so that in case of repair much more work needs to be done to replace a printing head. As a consequence, the necessary measures for replacing it are very time-consuming. This is particularly relevant, if a plurality of printing heads has to be replaced at different points at the printing module.

Thus one problem causing the slow replacement of the printing heads is the fact that in the printing modules known today only the above described constructional concept has been realized for receiving the printing head.

Therefore, there is a need for a printing module and a method which allows, despite the limited accessibility from the top, to replace a printing head at a printing module quickly and efficiently.

Thus it is the purpose of the present invention to indicate a printing module and a method ensuring at any time, despite the limited accessibility from the top, a quick replacement in case of repair.

This problem is solved by the printing module according to the invention according to claim 1, the inkjet printer according to the invention according to claim 10 and the method according to the invention according to claim 12 by providing or carrying out the replacement of the printing head at the printing module on the front side. The subclaims of the respective main claims describe their preferred variants.

In the scope of this description "front side" of the printing module is understood to mean the side of the printing module which looks directly at the depositing device for a medium to be printed.

In the scope of this description "to receive on the front side" is understood to mean an insertion of the printing head into the carrier on the front side.

Up to now all conventional printing modules have one thing in common and that is their construction being such that a printing head can only be received and replaced from the top of the printing module, i.e. only on the rear side at the carrier.

According to the invention a printing module is provided which comprises an assembly arranged on the front side for mounting a printing head in an inkjet printer, wherein the printing module is arranged at a distance in relation to a depositing device and the assembly has a carrier frame having an opening which extends through the carrier frame and is provided for receiving/releasing the printing head, characterized in that the assembly has means for mounting the printing head, which make it possible to receive the same on the front side in a repair position of the printing module in relation to the depositing device.

Repair position can mean that the distance between the printing module and the depositing device has been increased to allow a removal on the front side. But there are also other possible variants, such as the deposition of the printing head on a layer applied onto the depositing device. For inserting or removing the printing head(s) the rest of the printing module will simply be approached or removed.

The invention will be described in the following in detail and exemplary on the basis of the figures.

Figure 2:
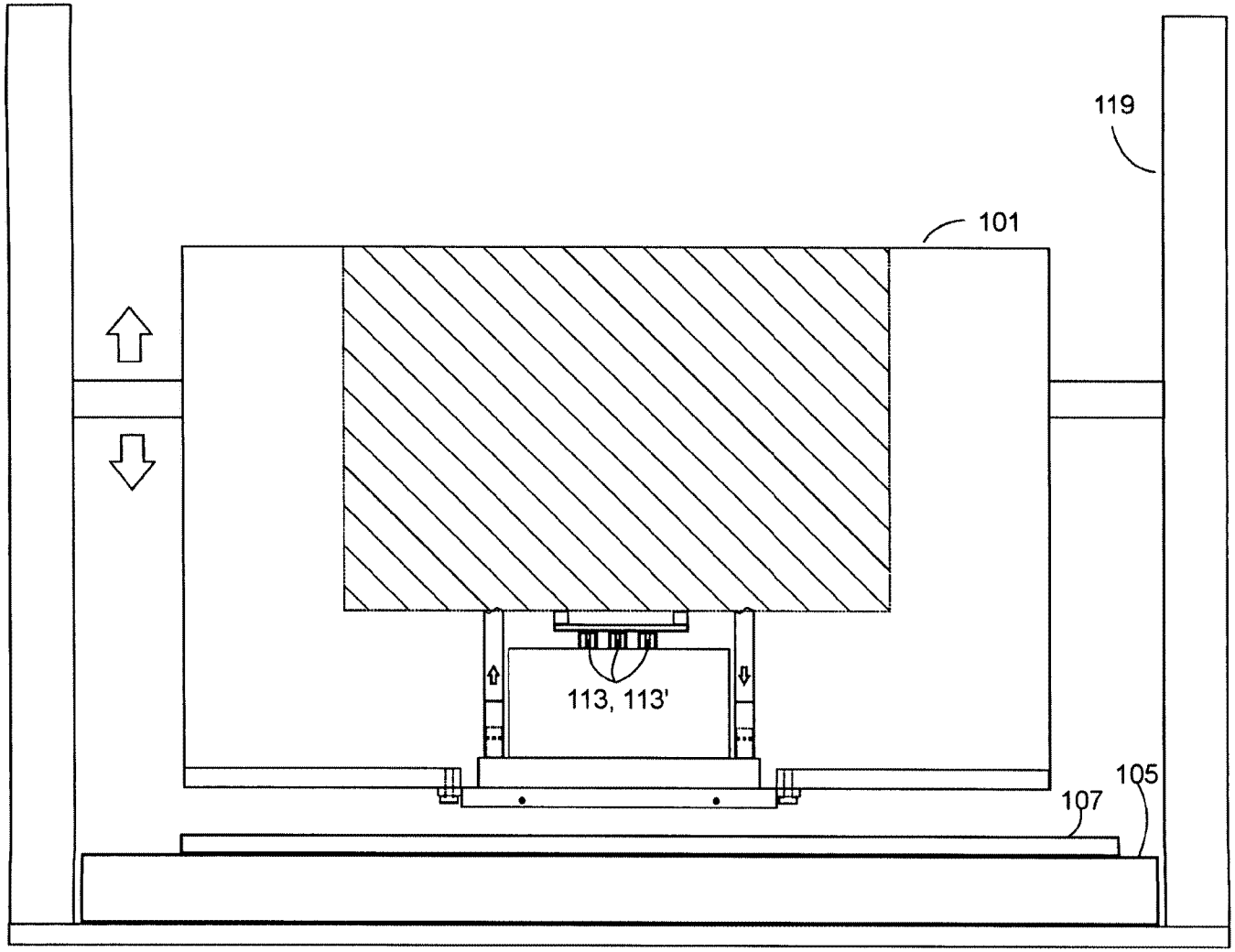
Figure 3:
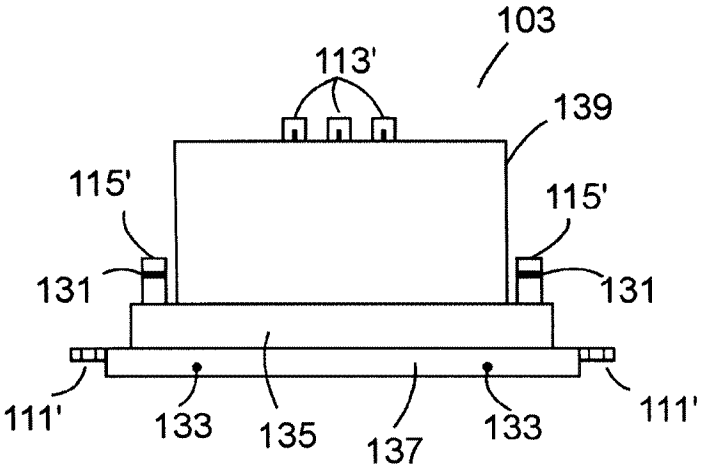
Figure 4:
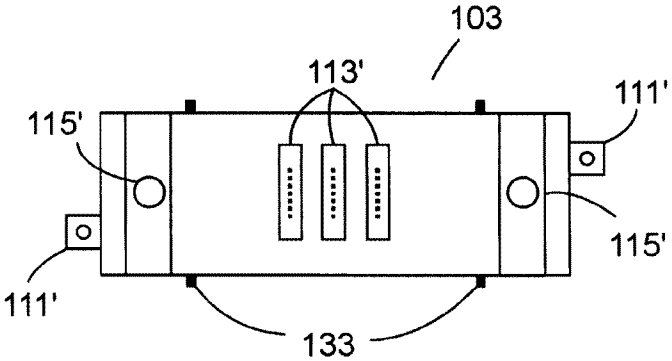
Figure 5:
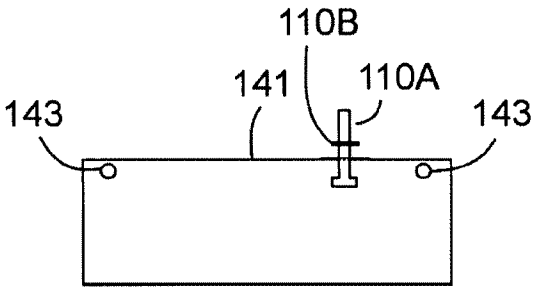

FIG. 1 shows a lateral view of a particularly preferred embodiment of the printing module 101 according to the invention in repair position in an inkjet printer FIG. 2 shows a lateral view of the particularly preferred embodiment of the printing module 101 according to the invention in working position in an inkjet printer FIG. 3 shows a schematic view of a printing head 103 in lateral view FIG. 4 shows a schematic view of the printing head 103 in top view FIG. 5 shows a schematic view of a change tool 141 for replacing the printing head 103

Figure 6:
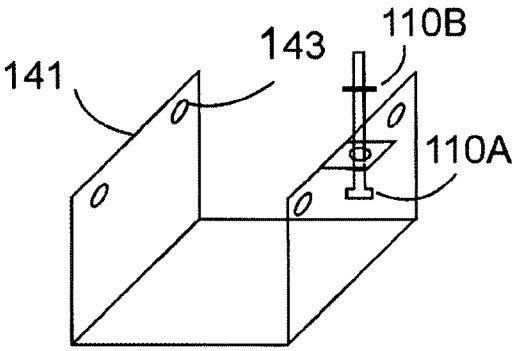

FIG. 6 shows a perspective view of a change tool 141 for replacing the printing head 103

Figure 7:
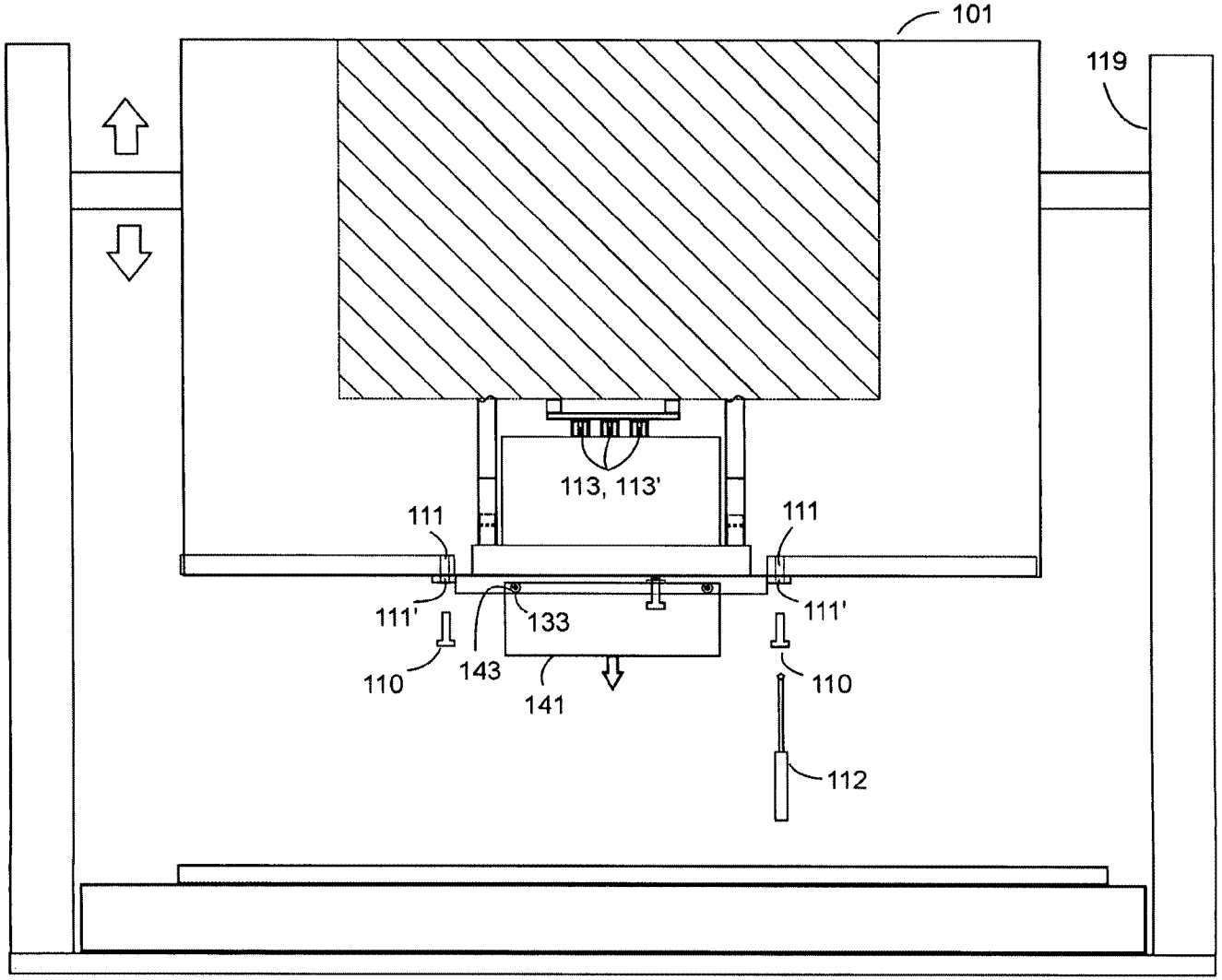

FIG. 7 shows a method step of a preferred embodiment of the method according to the invention in which the printing module 101 has been displaced and brought into repair position For reasons of clarity reference numerals have been omitted in some figures. It is, however, expressly pointed out that the reference numeral of an element of one FIGURE can be assigned to an identical element in another figure.

As it is shown in FIG. 1, the printing module 101 according to the invention comprises an assembly arranged on the front side for mounting a printing head 103 in an inkjet printer, wherein the printing module 101 is arranged at a distance in relation to a depositing device 105 and the assembly has a carrier frame 109 having an opening which extends through the carrier frame 109 and is provided for receiving/releasing the printing head 103, characterized in that the assembly has means for mounting the printing head 103 which make it possible to receive the same on the front side in the repair position of the printing module 101 in relation to the depositing device 105.

Preferred embodiments of the printing module 101 according to the invention are specified in detail in the following. The FIGS. 1 to 3 constitute a particularly preferred embodiment of an inkjet printing device according to the invention which combines the embodiments specified in detail in the following.

At the printing module 101 the means for the mounting can comprise in a preferred embodiment at least one installation means for the detachable fixation 111. Corresponding counter installation means 111' are provided at the printing head 103. The means for the mounting can comprise, in addition to the installation means for the detachable fixation 111, at least one coupling means for a temporary fixation 113, with corresponding counter coupling means 113' being provided at the printing head 103.

A temporary fixation of the printing head 103 to coupling means 113 of the printing module 101 ensures that the printing head 103 which has not yet been fastened detachably by fixing means 110 to the installation means 111 does not detach itself alone from the (preliminary) mounting position simply by the gravitational force acting downwards onto the printing head 103. Such printing head 103 fastened temporarily can be detached from the coupling means 111 only by external forces. Such coupling means for the temporary fixation 113 can for example be used advantageously, if a printing head 103 has to be mounted at the printing module 101 at a position which is rather difficult to reach, because it is no problem to work by one hand.

The installation means for the detachable fixation 111 and the corresponding counter installation means 111' can be provided in a preferred configuration as counterpart to a fixing means 110, which fixing means 110 can be designed as screwing device element or the coupling means for a temporary fixation 113 can be designed as electrical connecting element, in particular as printed circuit board connector (socket or plug).

The coupling means realized in a preferred embodiment for a temporary fixation 113 is preferably directed downwards and the corresponding counter coupling means 113' is directed upwards at the printing head 103.

In a further preferred embodiment the assembly can comprise at least one fluid-technical connection 115 for feeding and/or discharging ink, wherein the corresponding fluid-technical counter connections 115' are provided at the printing head 103.

In a particularly preferred embodiment of the printing module 101 according to the invention the at least one fluid-technical connection 115 and the at least one coupling means for the temporary fixation 113 are fastened floatingly. Such embodiment is particularly advantageous, if it is desired to ensure and achieve a very exact positioning of the printing head 103 in the assembly in one positioning step.

The at least one fluid-technical connection 115 and the at least one coupling means for the temporary fixation 113 can be arranged in such a manner that a simultaneous coupling/decoupling of the respective connectors is provided.

The at least one fluid-technical connection 115 can have an automatic locking device 117 so that during the decoupling of the fluid-technical connection 115 any leakage of ink can be avoided. This is particularly advantageous, because it prevents the depositing device 115 from getting soiled with ink during the replacement of the printing head 103.

In a further preferred embodiment the printing module 103 can comprise pre-set means for automatically aligning the printing head 103, wherein these can be adjusted in such a manner that they press the printing head 103 against two eccentrics arranged on two side walls of an edge of the carrier frame 109, when the printing head 103 is mounted in the assembly.

The ink jet printer according to the invention comprises the printing module 101 according to the invention in an embodiment in which also the above outlined preferred elements can be realized and a positioning device 119 which is designed to be able to modify the distance of the printing module 101 in relation to a depositing device 105 for a medium to be printed 107, wherein the printing module 101 can be displaced by the positioning device 119 between a working position and a repair position and during the printing of the medium to be printed 107 the printing module 101 can be positioned in the working position in relation to the depositing device 105 within a first distance interval, and during the replacement of the printing head 103 the printing module 101 can be positioned in the repair position in relation to the depositing device 105 within a second distance interval.

In a preferred configuration of the inkjet printer according to the invention the minimum distance of the second distance interval in the repair position corresponds at least to the height of the printing head 103.

FIG. 1 shows a particularly preferred embodiment of an inkjet printing device in which the printing module 101 has been brought into the repair position to ensure the replacement of the printing head 103. In this respect the printing module 101 is fastened adjustably to the positioning device 119 by means of adjusting devices 121. The positioning device 119 rests for example on a base plate 120. The at least one coupling means preferably provided at the printing module 101 for the temporary fixation 113 is fastened to a supporting device 125 which itself passes into an overhang 127. At least a part of the electronic and mechanic components which are necessary for the regular operation of the printing head 103 is arranged in the overhang 127. The fluid-technical connections 115 are connected in this embodiment in one piece to the fluid-technical lines 118 for feeding/discharging the ink.

FIG. 2, however, shows the printing module 101 which is positioned in a working position to be able to print the medium 107 to be printed which rests on the depositing device 105.

FIG. 3 shows the printing head 103 from FIG. 1 in an enlarged view. This printing head 103 comprises a base plate 137 which has at least one row of nozzles (not shown in the drawing), an ink chamber 135 having two fluid-technical counter connections 115' which are directed upwards and allow the circulation of ink through the ink chamber 135, a superstructure 139 comprising electrical contactings for the at least one row of nozzles and laterally arranged heating plates for the uniform heating of the ink chamber 135 (not shown in the drawing). Additionally, the printing head 103 comprises counter installation means 111' for the detachable fixation at the printing module 103, counter coupling means 113' for the temporary fixation at the printing module 103 and change means 141 which are arranged at the base plate 138 and can be used as auxiliary means for replacing the printing head 103. The fluid-technical counter connections 115' have sealing rings 131 which avoid any leakage of ink during the connection of the fluid-technical counter connections 115' to the corresponding fluid-technical connections 115.

FIG. 4 shows the printing head 103 from FIG. 3 in top view.

FIG. 5 shows a change tool 141 comprising counter change means 143. Counter change means are brought into mutual engagement with change means 133 fastened at the base plate 135 of the printing head 103. Such tool can be used as auxiliary means for replacing the printing head 103. Additionally, the change tool 141 comprises an integrated fixing means 110A. FIG. 6 shows a perspective view of the change tool 141.

In the scope of the description an integrated fixing means 110A is understood to mean a combined connection of a screw with a nut 1106 at the change tool, wherein the screw is inserted by a simple hole to the change tool 141 and fastened detachably by a screw/screw nut connection to the change tool 141.

The method according to the invention for mounting or replacing a printing head 103 at a printing module 101 in an inkjet printer according to the invention, in which an assembly is provided on the front side of the printing module 101, comprises the following steps:

a) displacing the printing module 101 into a repair position
b) if a printing head 103 has already been mounted in the assembly, removal of the means for the mounting of the printing head 103
c) removal of the printing head 103
d) insertion of a new printing head 103 into the assembly
e) mounting of the printing head 103 in the assembly with means for the mounting, wherein the removal of the printing head 103 associated with step c) and the insertion of the printing head 103 into the carrier frame 109 according to step d) are carried out on the front side.

In the method the printing module 101 can be provided with at least one installation means for the detachable fixation 111 and the printing head 103 can be provided with corresponding counter installation means 111' in such a manner that the printing head 103 is fastened detachably by fixing means 110 in the mounting step according to the above mentioned step e).

In a preferred method the printing module 101 is provided additionally with at least one coupling means for the temporary fixation 113 and the printing head 103 is provided with corresponding counter coupling means 113' in such a manner that the mounting step according to the above mentioned step e) is carried out in two steps, in a first step by fastening temporarily the printing head 103 to the at least one coupling means for the temporary fixation 113 before fastening the printing head 103 detachably in a second step to the installation means for the detachable fixation 111 by fixing means 110.

In a further preferred method the printing head 103 is provided with change means 133 and additionally a change tool 141 is provided which comprises counter change means 143 and an integrated fixing means 110A, wherein the removal and/or the insertion of the printing head 103 are carried out according to the corresponding steps c), d) in such a manner that the change means 133 of the printing head 103 are brought into engagement with the corresponding counter change means and before removing and/or after inserting the printing head 103 the change tool 141 and the integrated fixing means 110A are fastened detachably to auxiliary installation means provided on the front side at the carrier frame 109 and are removed after the execution of steps c) and/or d).

The fixing means 110 can be carried out on the front side and/or on the rear side into the installations means for the detachable fixation 111 provided for it and the corresponding counter installation means 111' with a fixing tool 112.

FIG. 7 shows a step of replacement in which the printing module 103 is positioned in the repair position.

As a matter of form it should be noted that for a better understanding the printing module 101 and its components are partially not drawn to scale in the figures and/or they are represented in an enlarged view and/or in a reduced view.

What is claimed is:

1. A printing module (101) comprising an assembly arranged on the front side for mounting a printing head (103) in an inkjet printer, wherein the printing module (101) is arranged at a distance in relation to a depositing device (105) and the assembly has a carrier frame (109) having an opening which extends through the carrier frame (109) and is provided for receiving/releasing the printing head (103), wherein the assembly has means for mounting the printing head (103), which make it possible to receive the same on the front side and to remove it on the front side in a repair position of the printing module (101) in relation to the depositing device (105), wherein the means for the mounting comprise at least one installation means for the detachable fixation (111) and additionally at least one coupling means for a temporary fixation (113) of the printing head (103), wherein corresponding counter installation means (111') and counter coupling means (113') are provided directly on the printing head (103) wherein the coupling means (113) being configured so that they allow a front-side insertion of the printing head (103) against the direction of gravity and that a printing head (103) temporarily fixated to the coupling means (113) is fixed such that the printing head (103) which has not yet been fastened detachably by fixing means (110) to the installation means (111) does not detach itself alone from the preliminary mounting position simply by the gravitational force acting downwards onto the printing head (103), but only can be detached from the coupling means (111) by external forces.

2. The printing module (101) according to claim 1, characterized in that the installations means for the detachable fixation (111) and the corresponding counter installation means (111') are provided each as counterpart for a fixing means (110), which fixing means (110) can be designed as screwing device element or the coupling element for the temporary fixation (113) as electrical connecting element, in particular as printed circuit board connector (socket or plug).

3. The printing module (101) according to claim 1, characterized in that the coupling means for a temporary fixation (113) is directed downwards and the corresponding counter coupling means (113') is directed upwards at the printing head (103).

4. The printing module (101) according to claim 1, characterized in that the assembly comprises at least one fluid-technical connection (115) for feeding and/or discharging ink, wherein corresponding fluid-technical counter connections (115') are provided at the printing head (103).

5. The printing module (101) according to claim 1, characterized in that the printing module (103) comprises pre-set means for automatically aligning the printing head (103), wherein these are adjusted in such a manner that they press the printing head (103) against two eccentrics arranged on two side walls of an edge of the carrier frame (109), when the printing head (103) is mounted in the assembly.

6. An inkjet printer comprising a printing module (101) according to claim 1 and a positioning device (119) which is designed to be able to modify the distance of the printing module (101) in relation to a depositing device (105) for a medium to be printed (107), characterized in that the printing module (101) can be displaced by the positioning device (119) between a working position and a repair position and during the printing of the medium to be printed (107) the printing module (101) can be positioned in the working position in relation to the depositing device (105) within a first distance interval, and during the replacement of the printing head (103) the printing module (101) can be positioned in the repair position in relation to the depositing device (105) within a second distance interval.

7. The printing module (101) according to claim 4, characterized in that the at least one fluid-technical connection (115) and the at least one coupling means for the temporary fixation (113') are fastened floatingly.

8. The printing module (101) according to claim 4, characterized in that the at least one fluid-technical connection (115) and the at least one coupling means for the temporary fixation (113) are arranged in such a manner that a simultaneous coupling/decoupling of the respective connections is provided.

9. The printing module (101) according to claim 4, characterized in that the at least one fluid-technical connection (115) has an automatic locking device (117) so that during the decoupling of the at least one fluid-technical connection (115) any leakage of ink can be avoided.

10. The inkjet printer according to claim 6, characterized in that in the repair position the minimum distance of the second distance interval corresponds at least to the height of the printing head (103).

11. A method for replacing a printing head (103) at a printing module (101) according to claim 1, wherein an assembly is provided on the front side of the printing module (101) and the method comprises the following steps:

a) displacing the printing module (101) into a repair position, b) if a printing head (103) has already been mounted in the assembly, removal of the means for the mounting of the printing head (103), c) removal of the printing head (103), d) insertion of a new printing head (103) into the assembly, e) mounting of the printing head (103) into the assembly with means for the mounting, wherein the removal of the printing head (103) associated with step c) and the insertion of the printing head (103) into the carrier frame (109) according to step d) are carried out on the front side, wherein the printing head (103) is provided with corresponding counter installation means (111') and with counter coupling means (113'), such that, the mounting step according to step e) is carried out in two steps, in a first step by fastening temporarily the printing head (103) to the at least one coupling means for the temporary fixation (113) before fastening the printing head (103) detachably in a second step to the installation means for the detachable fixation (111) by fixing means (110).

12. The method according to claim 11, characterized in that the printing head (103) is provided with change means (133) and additionally a change tool (141) is provided which comprises counter change means (143) and an integrated fixing means (110A), wherein the removal and/or the insertion of the printing head (103) is/are carried out according to the corresponding steps c), d) in such a manner that the change means (133) of the printing head (103) are brought into engagement with the corresponding counter change means (143) and before removing and/or after inserting the printing head (103) the change tool (141) and the integrated fixing means (110A) are fastened detachably to auxiliary installation means provided on the front side at the carrier frame (109) and are removed after the execution of steps c) and/or d).

* * * * *